US008277272B1

(12) United States Patent
Wemesfelder

(10) Patent No.: US 8,277,272 B1
(45) **Date of Patent: *Oct. 2, 2012**

(54) FLOTATION APPARATUS

(76) Inventor: William R. Wemesfelder, Venice, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/070,043

(22) Filed: Mar. 23, 2011

Related U.S. Application Data

(60) Provisional application No. 61/324,424, filed on Apr. 15, 2010.

(51) Int. Cl.
*B63C 9/08* (2006.01)

(52) U.S. Cl. ..... 441/129; 114/61.16

(58) Field of Classification Search ..... 114/144 RE, 114/144 A, 61.15–61.19, 61.23, 66, 283, 114/265, 39.26, 39.28; 359/895; 441/43, 441/129, 135; D12/316
See application file for complete search history.

(56) References Cited

U.S. PATENT DOCUMENTS

| | | | | |
|---|---|---|---|---|
| 2,347,959 | A * | 5/1944 | Moore et al. | 114/283 |
| 2,948,251 | A | 8/1960 | Replogle | |
| 2,968,208 | A * | 1/1961 | Shaw | 359/406 |
| 3,101,691 | A | 8/1963 | Wendt | |
| 3,139,055 | A | 6/1964 | Nutting | |
| 3,141,435 | A * | 7/1964 | Moffitt, Jr. | 114/39.26 |
| 3,638,598 | A | 2/1972 | Vlad | |
| 3,656,445 | A * | 4/1972 | Padwick | 114/39.25 |
| 4,316,424 | A * | 2/1982 | McKenna | 114/39.27 |
| 4,361,103 | A | 11/1982 | Willat | |
| 4,624,207 | A | 11/1986 | King | |
| 4,798,550 | A * | 1/1989 | Biancucci | 441/129 |
| 5,134,955 | A | 8/1992 | Manfield | |
| 5,178,090 | A | 1/1993 | Carter | |
| 5,520,130 | A * | 5/1996 | Upchurch | 114/61.2 |
| 5,605,111 | A | 2/1997 | Culpepper | |
| 6,145,462 | A | 11/2000 | Aquino | |
| 6,561,116 | B2 | 5/2003 | Linjawi | |
| 6,612,254 | B1 | 9/2003 | Arthur | |
| D652,780 | S * | 1/2012 | Wemesfelder | D12/316 |

* cited by examiner

*Primary Examiner* — Edwin Swinehart
(74) *Attorney, Agent, or Firm* — Charles J. Prescott

(57) ABSTRACT

A flotation apparatus including a frame configured to support a snorkeler lying in a prone position. A plurality, preferably six, of elongated arms are each pivotally attached at a proximal end thereof to the frame with a buoyant float positioned on a distal end of each arm for enhanced stability. Preferably, a propulsion apparatus is mounted to the frame and a control apparatus for operating the propulsion apparatus in a prone position is provided.

5 Claims, 11 Drawing Sheets

FLOTATION APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

A floatation apparatus is disclosed for supporting and propelling a user(s) on the water particularly while snorkeling. The apparatus may include a frame configured to support and propel a user, with the frame being buoyed in the water by an arrangement of floats that are each connected to the frame by an arm.

2. Description of Related Art

A variety of devices are commercially available to assist snorkeling and/or SCUBA diving enthusiasts in the enjoyment of their sport. The most common of these devices are diving planes and sleds. Planes and sleds are, however, ill suited for those that may wish to participate in or host dedicated snorkeling activities. Planes that function as portable submersible devices are, for example, designed to travel for significant periods of time at depth underwater. This makes them of little practical use to a snorkeler, who must routinely remain at or near the surface of breath. Many planes and sleds also come with the added expense of a boat, which is required to pull the device through the water. Therefore, it would be advantageous to have a standalone dedicated apparatus for snorkelers that has independent source of propulsion. Such a device could, for example, be used by guests of hotels and resorts who would like to experience snorkeling but do not know how to SCUBA dive or how to use a towed dive plane or sled.

U.S. Pat. No. 2,948,251 to Replogle discloses a diving plane for towing one or more divers at various depths beneath the surface of the water. Wendt teaches an operator controlled towed underwater sled in U.S. Pat. No. 3,101,691. An apparatus to be towed behind a motor boat while permitting controlled motion beneath the water and on the surface of the water is taught by Nutting in U.S. Pat. No. 3,139,055.

Vlad teaches a water vehicle on which a rider may be towed by a boat either on or beneath the surface of the water in U.S. Pat. No. 3,638,598. A highly controllable water sled device having an adjustable buoyancy feature is taught by Willat in U.S. Pat. No. 4,361,103. U.S. Pat. No. 4,624,207 to King discloses an underwater diving plane towed by a boat and ridden by a diver.

U.S. Pat. No. 5,134,955 to Manfield discloses a submersible two passenger dive sled. An underwater diving plane is taught by Carter in U.S. Pat. No. 5,178,090. Culpepper teaches a submersible aquatic sled capable of towing a diver both on and below the surface of the water in U.S. Pat. No. 5,605,111.

A towable and steerable diver aid is disclosed in U.S. Pat. No. 6,145,462 to Aquino. U.S. Pat. No. 6,561,116 to Linjawi discloses a sub-aqua device for towing a person through the water. Arthur teaches a towable underwater kite for towing riders on or through the water in U.S. Pat. No. 6,612,254.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a flotation apparatus including a frame configured to support an individual sitting or lying in a prone position. A plurality (preferably six) of elongated arms are each pivotally attached at a proximal end thereof to the frame with a buoyant float positioned on a distal end of each arm for enhanced stability. Preferably, a propulsion apparatus is mounted to the frame and a control apparatus for operating the propulsion apparatus in a prone or a seated position is provided.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
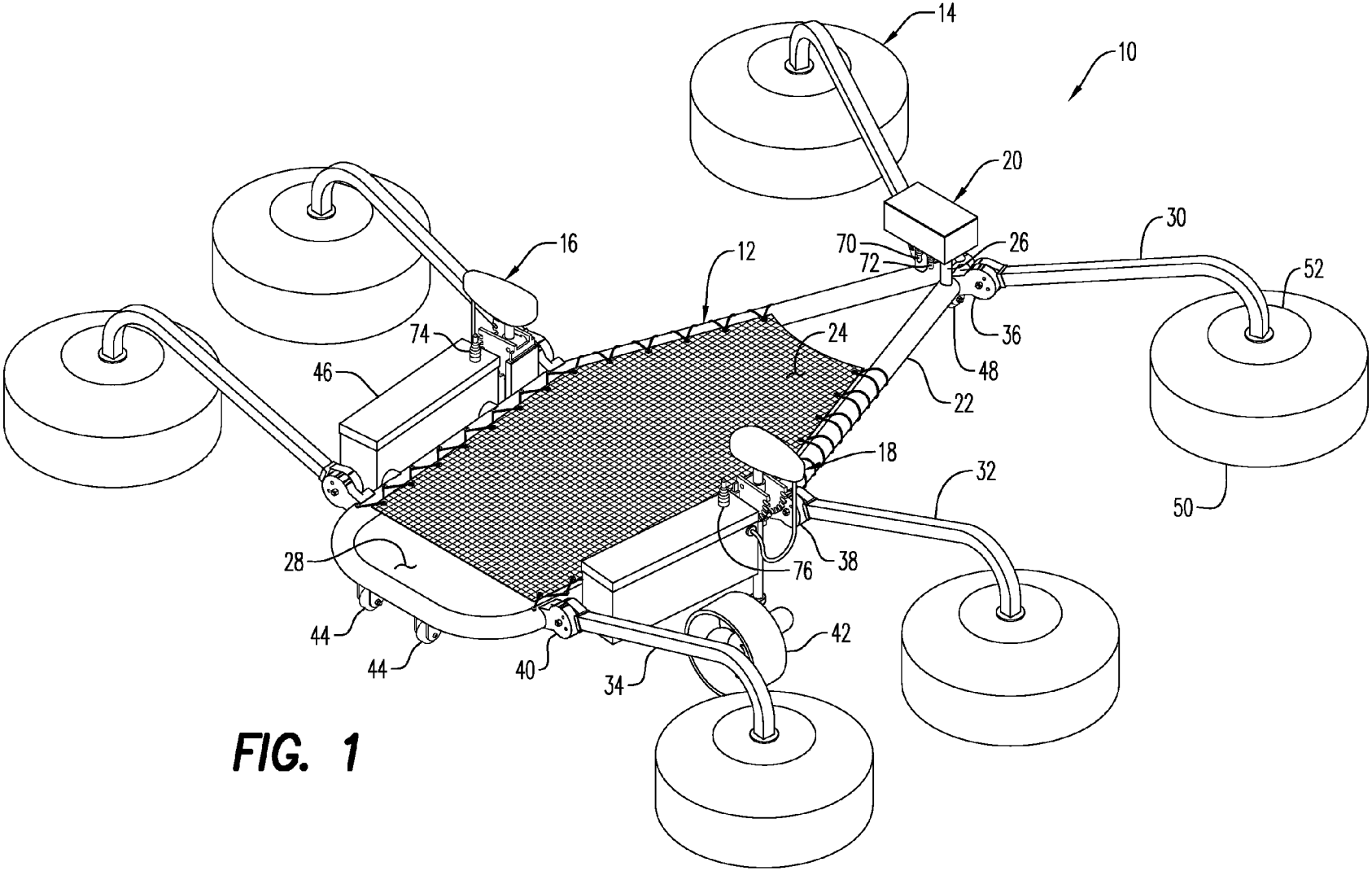
FIG. 1 is a perspective view of an embodiment of the flotation apparatus.

Exemplary embodiments are illustrated in reference figures of the drawings. It is intended that the embodiments and figures disclosed herein are to be considered to be illustrative rather than limiting.

DETAILED DESCRIPTION OF THE INVENTION

Nomenclature

10. flotation apparatus
12. frame
14. flotation assembly
16. propulsion motor
18. propulsion motor
20. control system
22. aluminum tube
24. user support netting
26. upright support
28. interior space
30. arm
32. arm
34. arm
36. arm mount assembly
38. arm mount assembly
40. arm mount assembly
42. shrouded propeller
44. rear wheel
46. container
48. front wheel
50. buoyant float
52. top plate
54. arm mounting plate
56. bolt
57. nut
58. bottom plate
60. locking pin
62. retainer
64. fixed mounting plate
66. cavity
68. locking pin aperture
70. left joystick
72. right joystick
74. alternate left joystick
76. alternate right joystick
78. facial opening
80. mounting flange
82. viewing box
84. neck clearance
86. transparent viewing bottom
90. canopy
92. upright support
94. canopy bow
96. canopy canvas
98. upright support A flotation apparatus is provided that may be used for carrying a snorkeler(s) on a body of water. The apparatus may include a frame configured to support and propel a user in a prone position, with the frame being buoyed in the water by an arrangement of floats that are each connected to the frame by an articulatable arm. A propulsion system may be included for driving the apparatus, with a control system also being provided to operate the propulsion system. In operation, the arms (with associated floats) may be pivoted down from a storage positioned and fixed in positioned relative to the frame and then the entire apparatus may be placed in a body of water. Once on the water, the frame will be located on or proximate the surface depending on the position in which the arms were fixed. A user may then lay in a prone and facedown position along the frame such that the user's body and face are supported at a constant position above or at a depth below the surface. Then, using the control system, the user may activate the propulsion system and drive the apparatus across the surface of the water.

Figure 15:
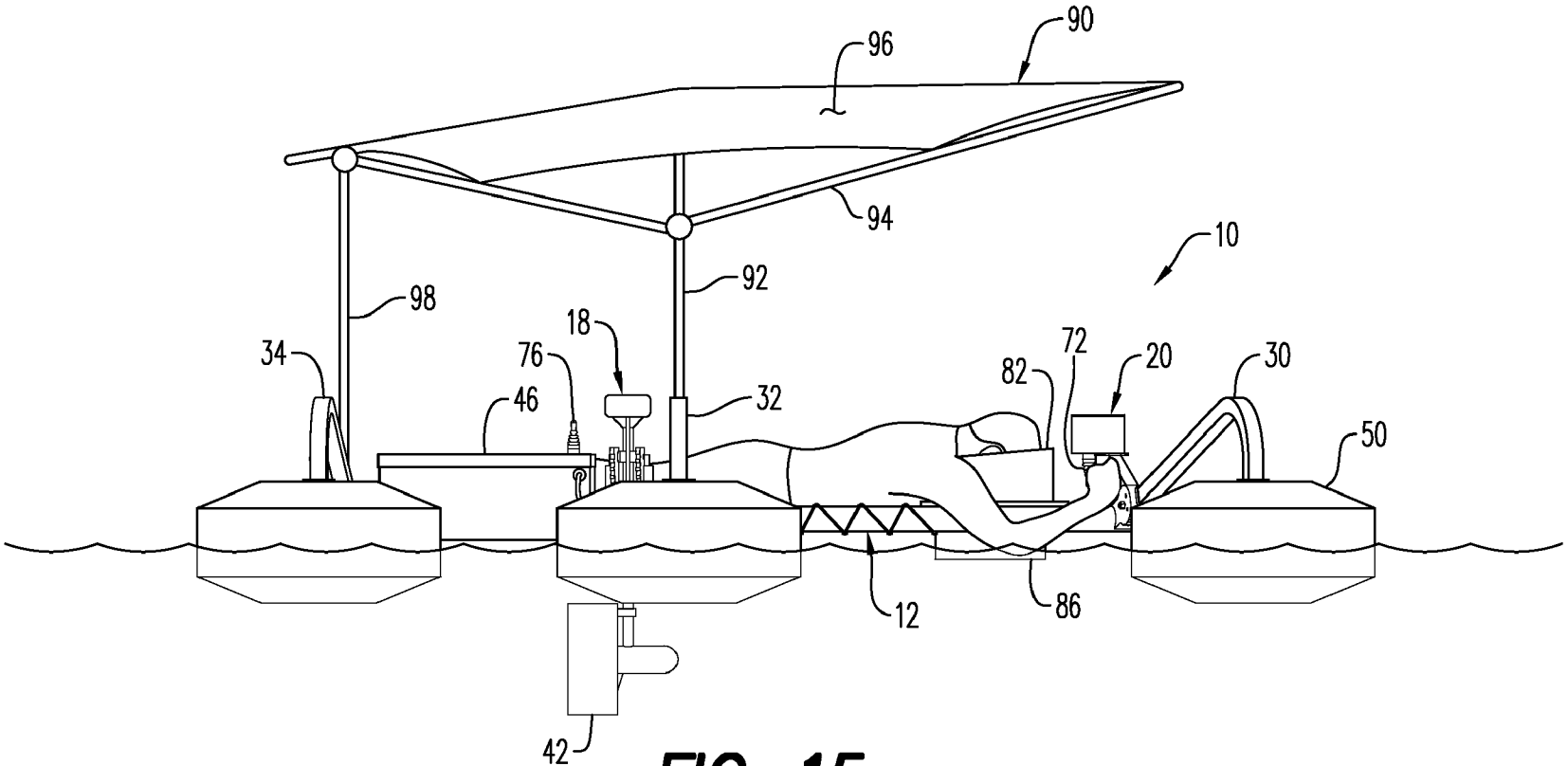
FIG. 15 is a side elevation view of FIG. 1 showing a user in a prone position with the addition of a canopy overhead.

Referring now to FIGS. 1 to 7, an apparatus 10 is provided that may be used for carrying a snorkeler(s) on a body of water as shown in FIG. 15. The apparatus 10 may include a frame shown generally at numeral 12 configured to support and propel a user in a prone or seated position, with the frame 12 being buoyed in the water by an arrangement of floats 50 that are each connected to the frame 12 on either side thereof by articulatable arms 30, 32 and 34.

A propulsion system including battery-powered trolling motors 16 and 18 may be included for driving the apparatus 10, with a control system 20 also being provided to operate the propulsion system 16/18. In operation, the arms 30, 32 and 34 with associated floats 50 may be pivoted down from a storage position in the direction of arrows A, B and C in FIG. 8 and fixed in position relative to the frame 12 and then the entire apparatus 10 may be placed in a body of water. Once on the water, the frame 12 will be located on or proximate to the surface of the water depending on the angular position in which the arms 30, 32 and 34 were fixed (described below). A user then may lie in a prone and facedown position along the frame 12, as shown in FIG. 15, such that the user's body and face are supported at a constant position above or at a depth below the surface. Then, using the control system 20 for the apparatus 10, the user may activate the propulsion system 16/18 and drive the apparatus 10 across the surface of the water.

Note that each of the arms 30, 32 and 34 may be independently positioned to accommodate a load in balance or to achieve a desired angular orientation of the frame 12 to the surface of the water. Note further that any propulsion apparatus may be viewed as optional, allowing for arm or finned leg propulsion by the user, particularly in a prone position.

The frame 12 of the apparatus 10 may be substantially planar in dimension and formed by configuring and welding together the forward ends of an approximately 2" diameter aluminum tube 22. The forward end of the frame 12 may be formed by joining the ends of tube 22 together at an acute angle best seen in FIG. 4 to define an interior space 28 of the frame 12. From this apex or forward end, the tube 22 may taper outward and extend about 3' to an approximate midpoint of the frame 12. At the midpoint, side of the tube 22 may be configured to form an obtuse angle relative to the interior space 28. The tube 22 may then taper inward for about 3.5° to a rearward end of the frame 12 where the tube 22 is bent transversely and may be a length of about 2' so that the frame 12 as a whole takes on a generally five-sided configuration. Thus, in one non-limited example, an embodiment of the frame 12 may have an overall length of about 6'7" and a maximum width of about 2'6". The interior space 28 of the frame 12 may be covered with a predetermined selection of fabric, mesh or netting 24 that extends across the frame 12 and is secured in space around the tube 22 by lacing 24*a* to support a user lying lengthwise of the frame 12 or seated. Wheels 44 and 48 may also be mounted to the frame 12 proximate the ends for use in rolling the apparatus 10 over land when not in use.

Figure 10:
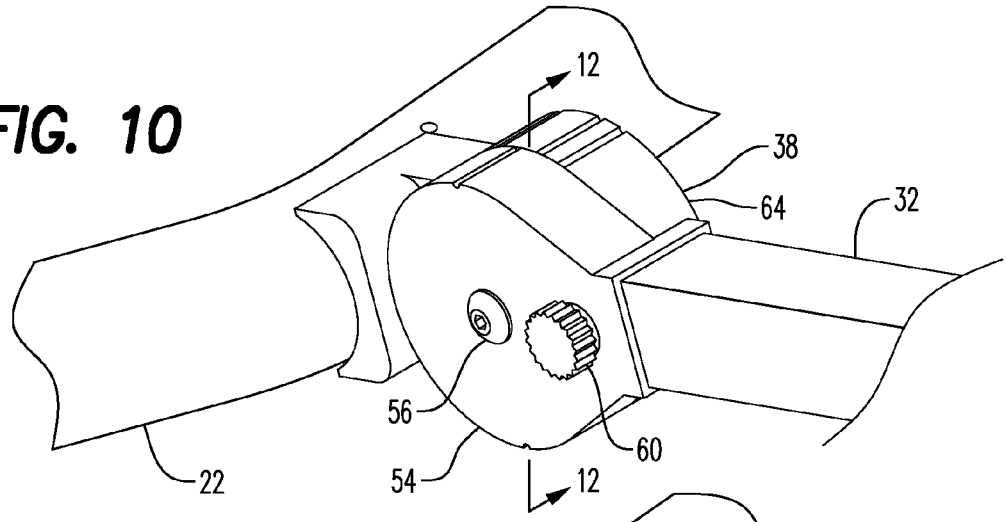
FIG. 10 is an enlarged perspective view of an arm mount assembly.
Figure 11:
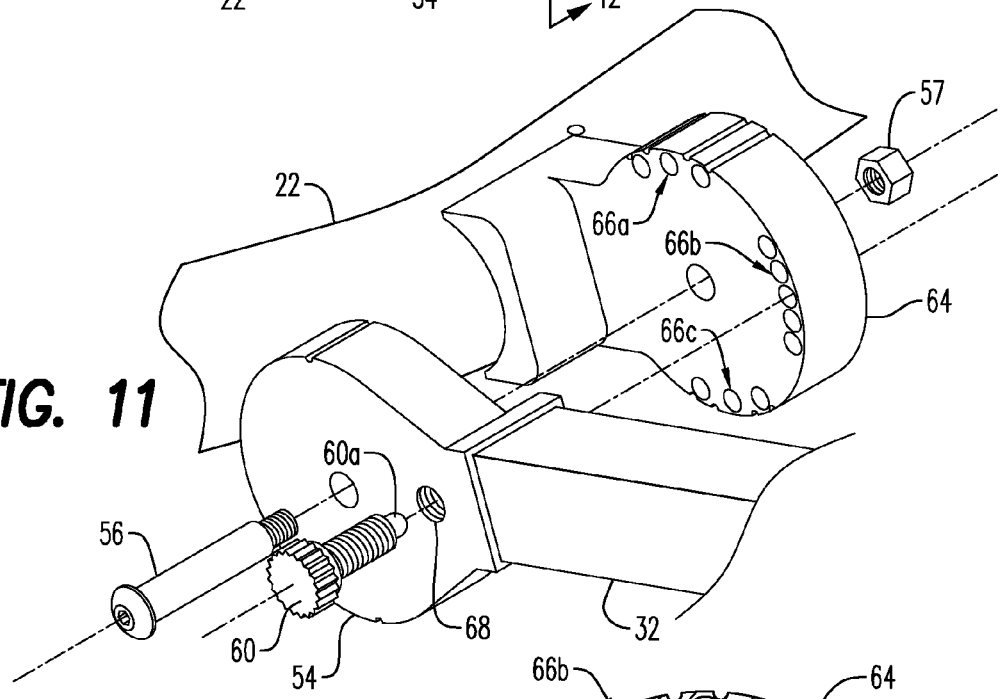
FIG. 11 is an exploded view of FIG. 10.
Figure 12:
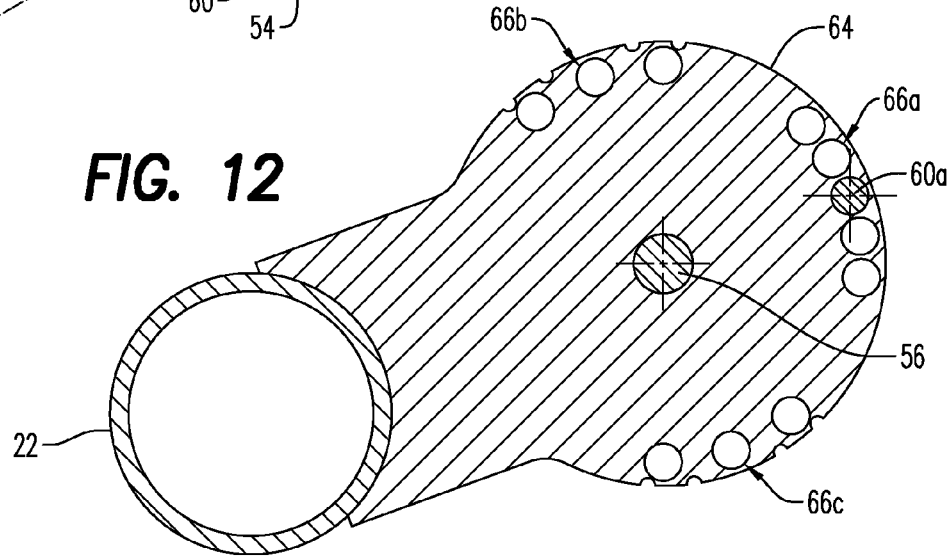
FIG. 12 is a section view in the direction of arrows 12-12 in FIG. 10.

Arm mount assemblies 36, 38 and 40 may be welded or otherwise fixed to and along either side of the frame 12 at predetermined locations along the tube 22 proximate the forward end, the rearward end 32, and at or proximate the widest or midpoint of the frame 12. Referring to FIGS. 10 to 12, each of the mount assemblies 36, 38 and 40 may be substantially disc-like in configuration and, by using mount assembly 38 (left-hand) as an example, include a movable front mounting plate 54 and a fixed rear mounting plate 64. The mounting plates 54 and 64 may also each include a center aperture—as will be discussed infra—for engagement with a bolt 56 to support one of the arms 32. In addition, a series of cavities 66 may be defined proximate the perimeter of each mounting plate 64 and used for receiving a pin 60*a* extending from a proximal end of a threaded locking pin 60 threadably engaged into threaded aperture 68*a* to hold each arm 32 in desired position relative to the frame 12.

Figure 2:
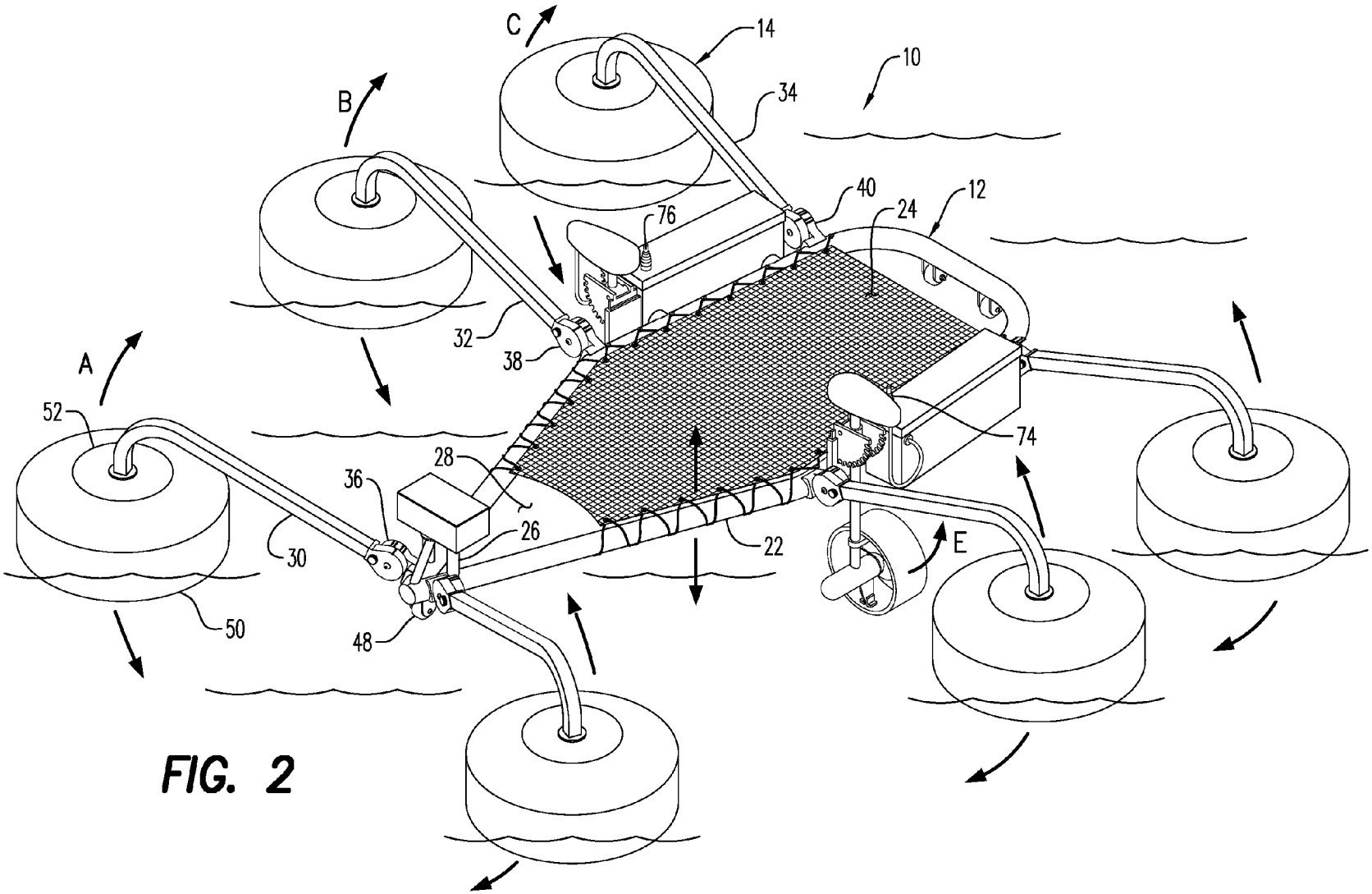
FIG. 2 is another perspective view of an embodiment of FIG. 1.

Each arm 30, 32 and 34 of the apparatus 10 may articulate in the direction of arrows A, B and C with respect to the frame 12 as seen in FIG. 2. For example, as shown, each arm 30, 32 and 34 may be pivoted up and down on (and also removably connected to) its corresponding mount assembly 36, 38 and 40. Also, like the frame 12, each arm 16 may be constructed from a 2" diameter aluminum tube or, preferably 2" square aluminum tube. However, other materials that meet the requisite strength and rust resistance characteristics may be used. The arms 30, 32 and 34 may also each have a length of between 1' and 6', or longer.

Figure 9:
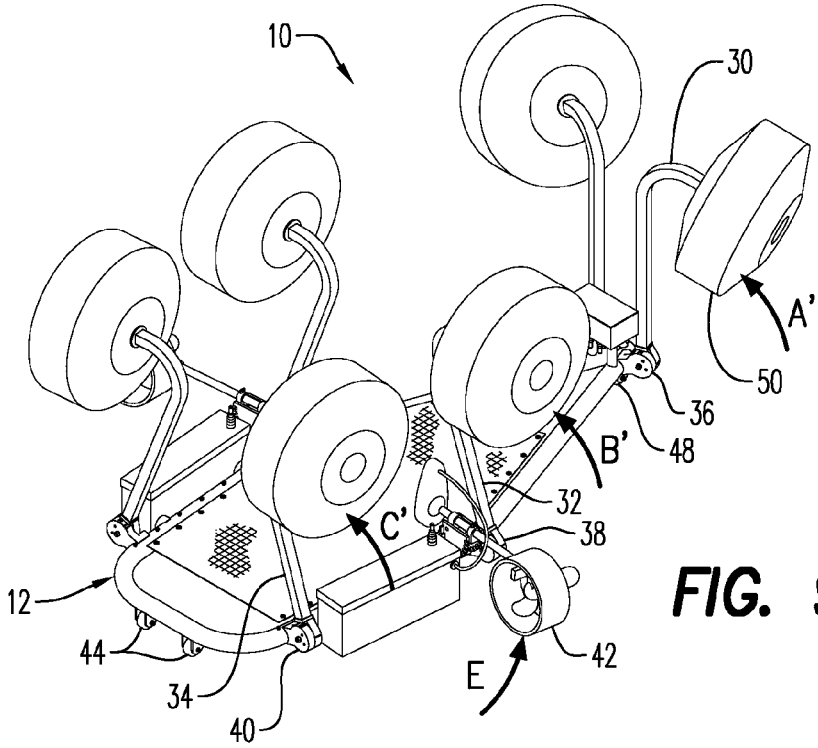
FIG. 9 is a view of FIG. 8 showing the arms and attached buoyant floats in an upward stored orientation.

Still referring to FIGS. 10 to 12, the arm mounting plate 54 attached to the proximal end of each arm may be substantially disc-like in configuration and include a rear face that is engageable with the front face of the fixed mounting plate 64 connected to the frame 12. Each arm 30, 32 and 34 may be folded up for storage by moving or pivoting the arms in the direction of arrows A', B' and C' and tilting the motors 16 and 18 up in the direction of arrow E relative to the frame 12 as shown in FIG. 9. The front face of fixed mounting plate 64, for example, may include a bolt 56 that is moveably received and supported through the center aperture of the mount assembly 36 of the frame 12. The bolt 56 may thus be extended through the apertures of the mount assembly 36 and tightened into nut 57 to hold each arm 32 in a user predetermined position relative to the frame 12.

An opposite end 54 of each arm 16 may be curved downwardly into a substantially vertical orientation so that, as described infra, it may be fitted with a float 14. To further insure the quick and secure selected angular orientation of each of the arms 32 as seen by example in FIGS. 10 to 12, a hand-operated locking pin 60 threaded through aperture 68 in the mounting plate 54 aligns with one of three series of cavities 66*a*, 66*b* and 66*c* by the moveable angular orientation of the arm 32. The rounded distal end 60*a* of locking pin 60 forms an alignment pin 60*a* which positively engages in one of the cavities 66. Note that cavities 66*a* are provided in a sequence which would correspond to the normal in-use positioning of the arm 32, cavities 66*b* are in an array and orientation around the periphery of fixed mounting plate 64 corresponding to the stored orientation of each of the arms 32, while cavities 66*c* are provided for orienting each of the arms positioned on the opposite side of frame 12 in an angular orientation so as to make the fixed mounting plates 64 ambidextrous. Note that threaded locking pin 60 may be replaced by a spring-biased locking pin which is locked and unlocked by a push-pull motion for quicker arm position readjustment.

Figure 3:
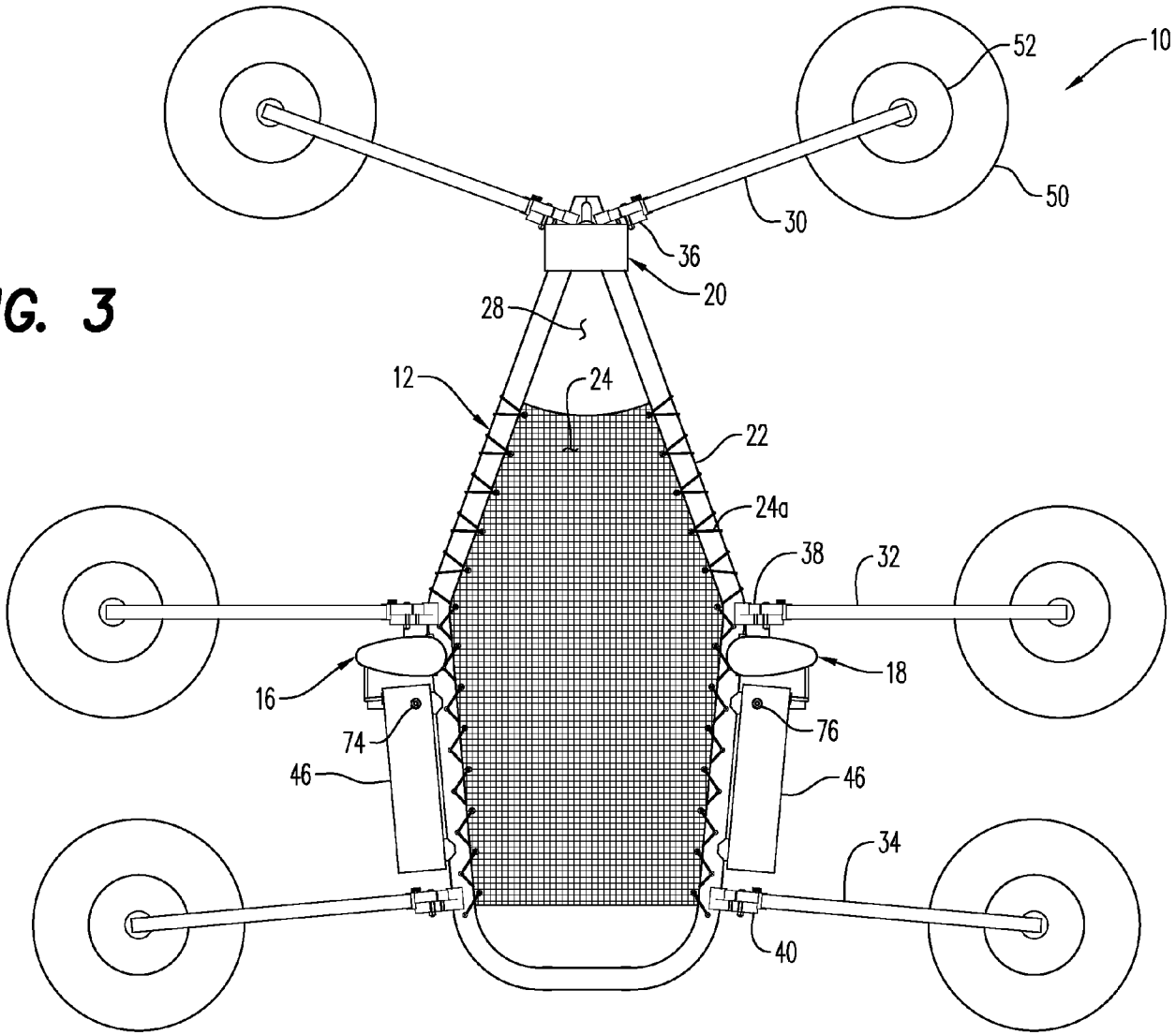
FIG. 3 is a top plan view of FIG. 1.
Figure 4:
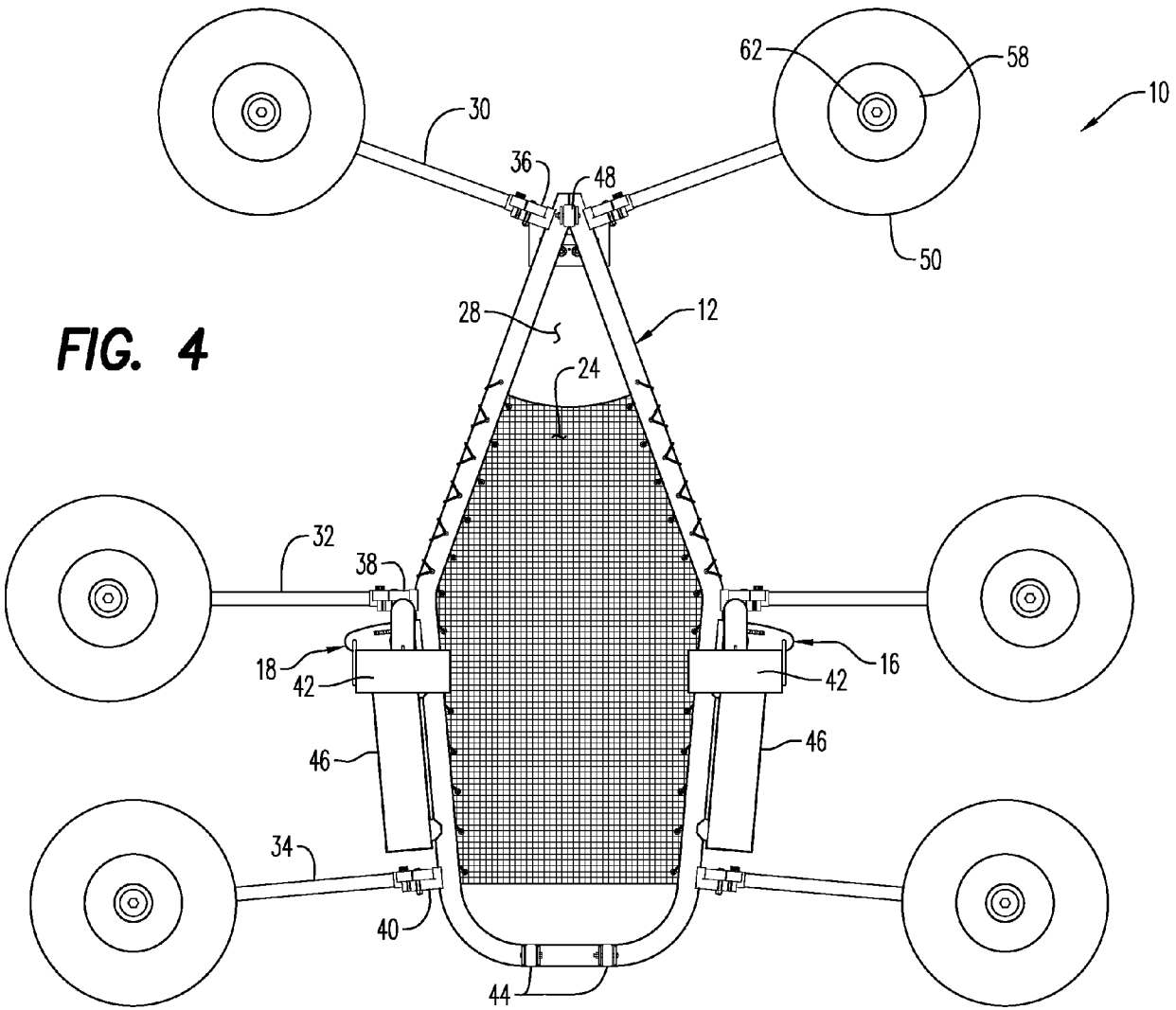
FIG. 4 is a bottom plan view of FIG. 1.
Figure 5:
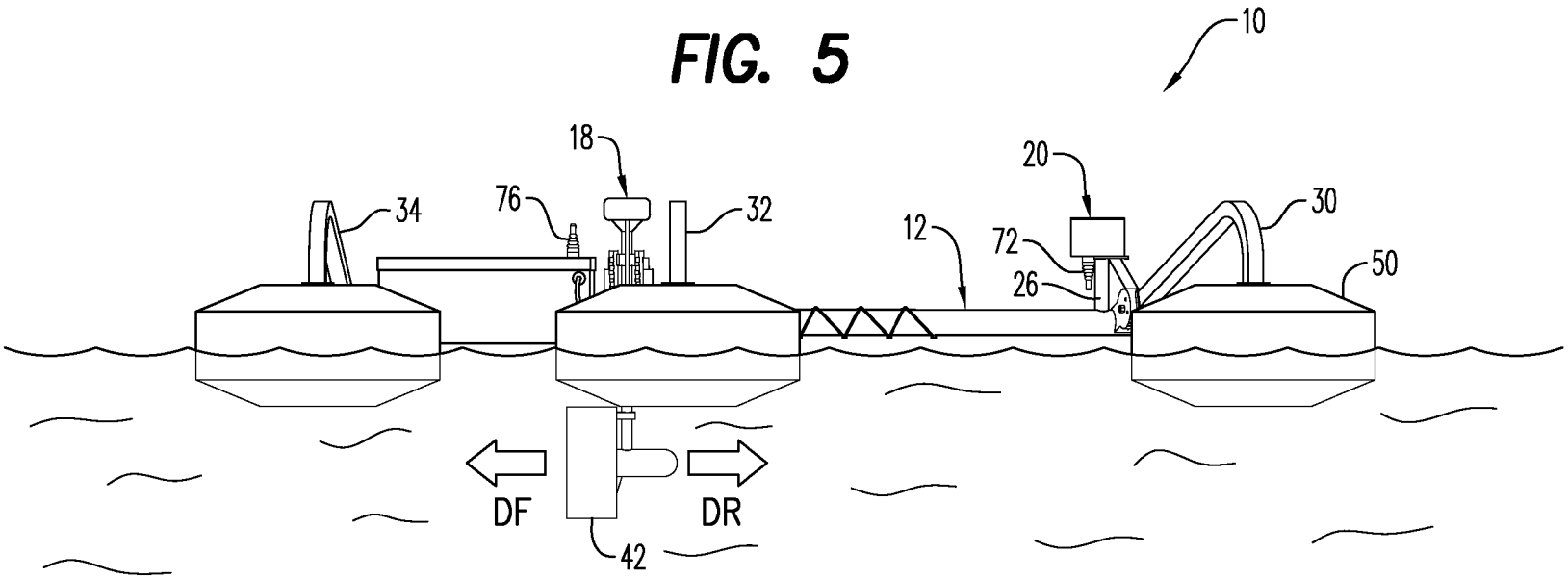
FIG. 5 is a right side elevation view of FIG. 1.
Figure 6:
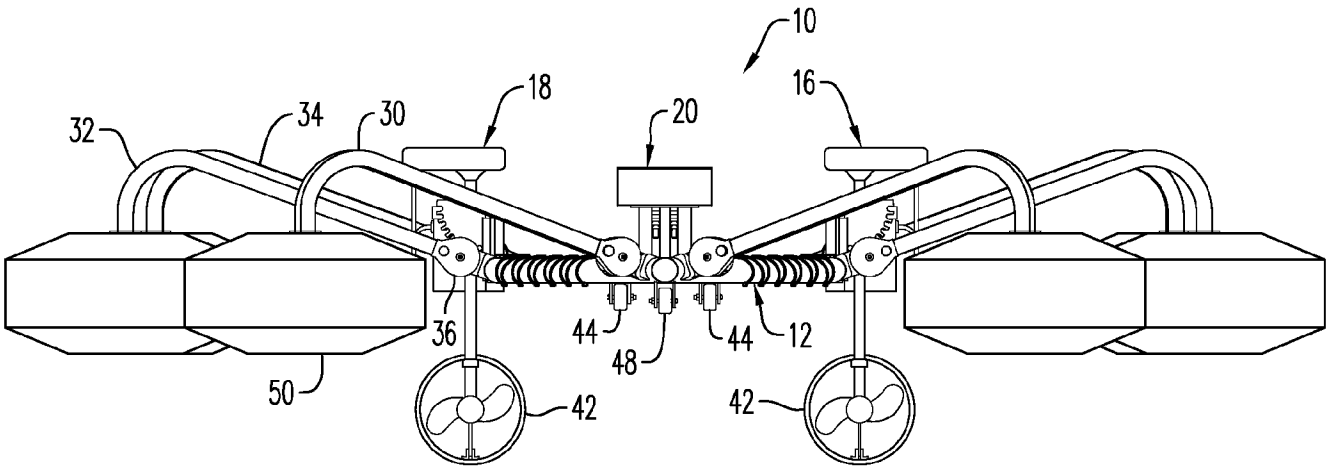
FIG. 6 is a front elevation view of FIG. 1.
Figure 7:
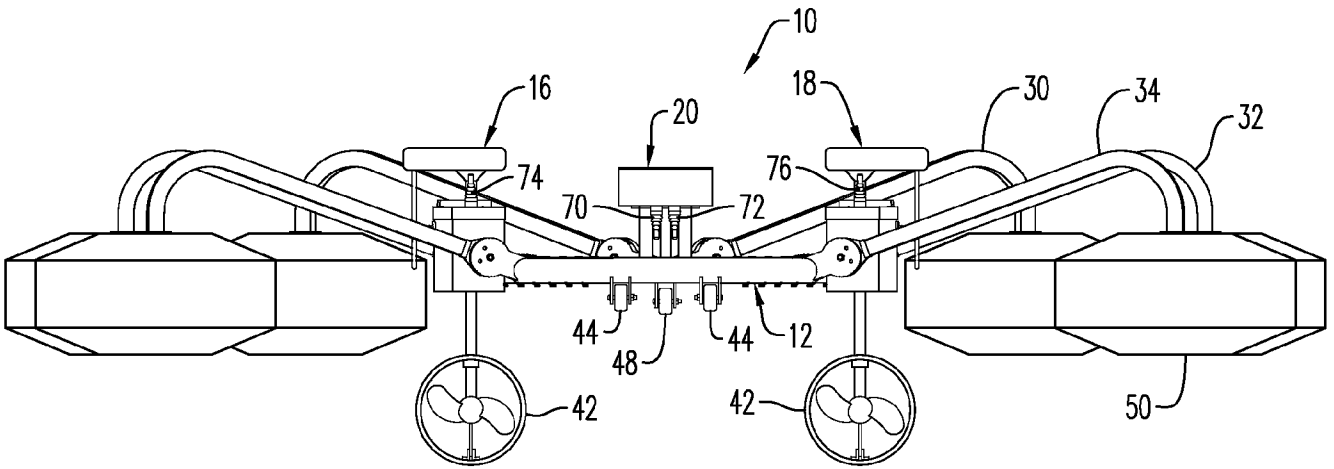
FIG. 7 is a rear elevation view of FIG. 1.

The float(s) 50 of the apparatus 10 may be constructed as inflatable rubber, hollow sealed plastic shells, or foam type floats. For example, each float 50 may include a rubber torus (i.e., "doughnut") shaped inner tube float having a diameter of about 16" and a height of 10". As best seen in FIGS. 3 and 4, each float 50 may thus be fitted about the distal end of an arm 30, 32 or 34 and secured in position by top and bottom plates 52 and 58 and that are secured to the distal end of each arm above and below the float 50 by retainer 62.

Figure 13:
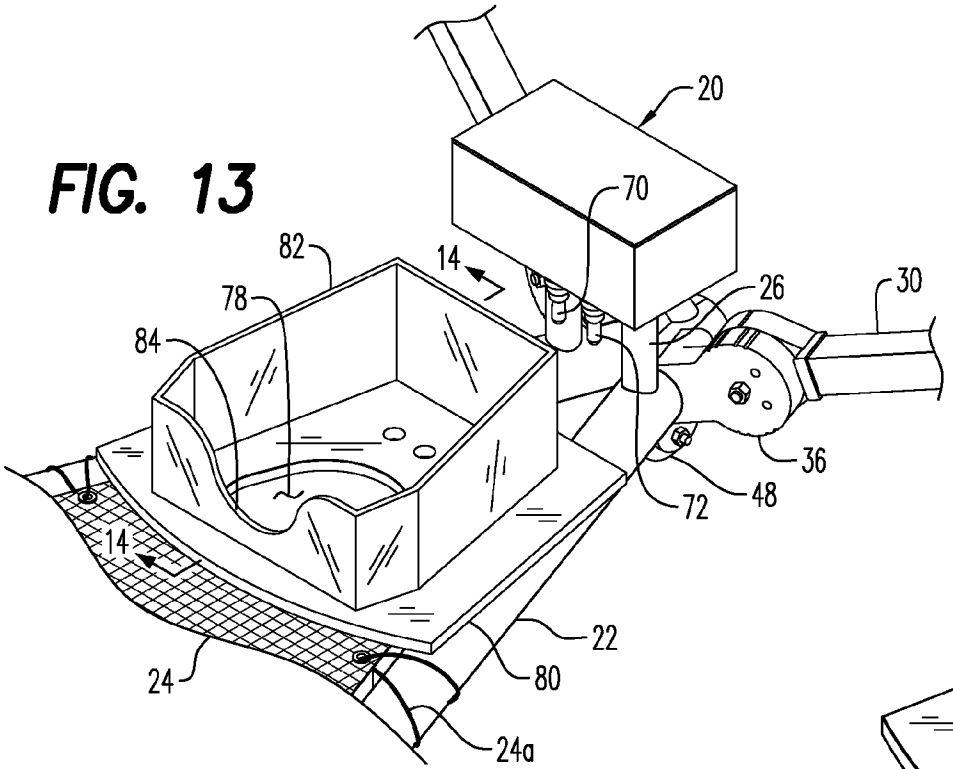
FIG. 13 is an enlarged perspective view of the front portion of the apparatus 10.
Figure 16:
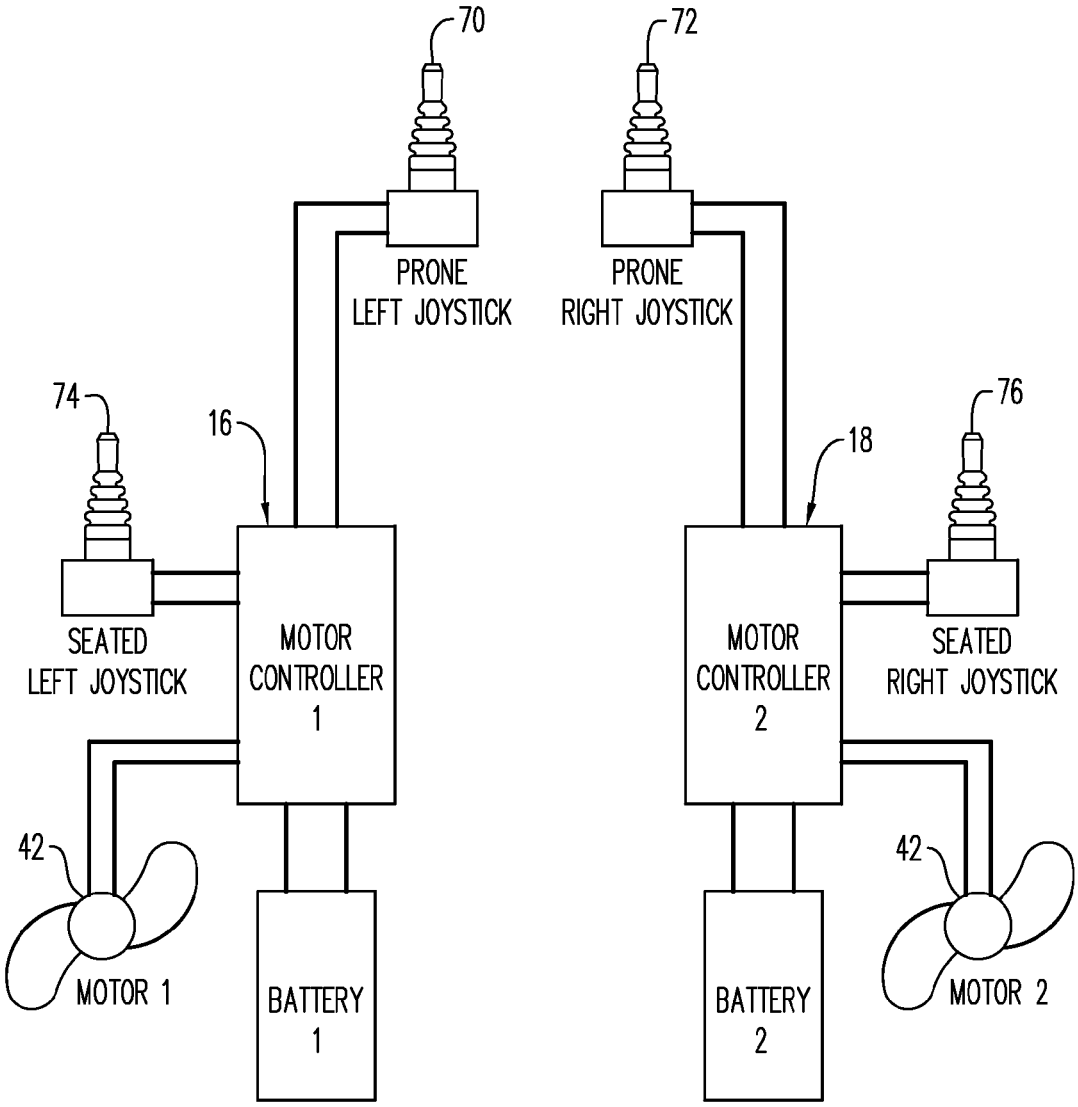
FIG. 16 is a simplified schematic view of the propulsion and control system.

The optional propulsion system 16/18 of the apparatus 10 may include one or more batteries (FIG. 16) and a shrouded propeller 42 of each motor 16 and 18 with each battery being positioned in an aluminum container 46 mounted to the frame 12 and extending outboard of the frame 12. (Alternately, water jets (not shown) may be mounted outboard of the containers 46 on a support (not shown) of frame 12. Each support may include one or more water intake ports for the jet(s) and one or more exhaust ports.) The motors 16 and 18 (or the jets not shown) may then be controlled by the control system 20 (FIGS. 13 and 16) positioned in another aluminum container positioned proximate the forward end of the frame 12. As seen in FIG. 16, the control system 20 may feature a pair of joysticks 70 and 72 that extend downwardly through the bottom of the aluminum container and operate to control the motors 16 and 18 (or thrust of the jets not shown). A second pair of joysticks 74 and 76 may be located at the tops of containers 46 for a user in a seated position.

Figure 8:
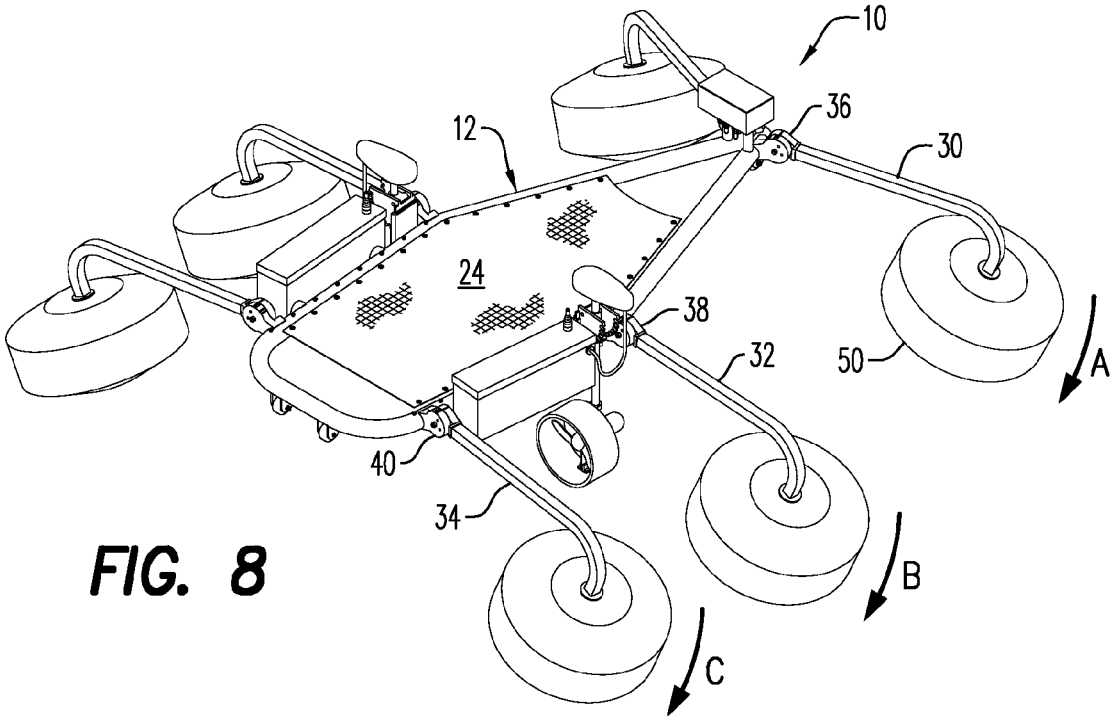
FIG. 8 is a perspective view of FIG. 1 showing the arms and attached buoyant floats in a downward orientation.

Referring now to FIG. 8, the vertical positioning of the frame 12 and the user support netting 24 may be raised by the lowering in the direction of arrows A, B and C of each of the arms 30, 32 and 34 and fixing the selected orientation as previously described with respect to FIGS. 10 to 12. In a furthermost downwardly orientation of each of the floats 50, the user support netting 24 will position the body of the user well above the surface of the water.

Figure 14:
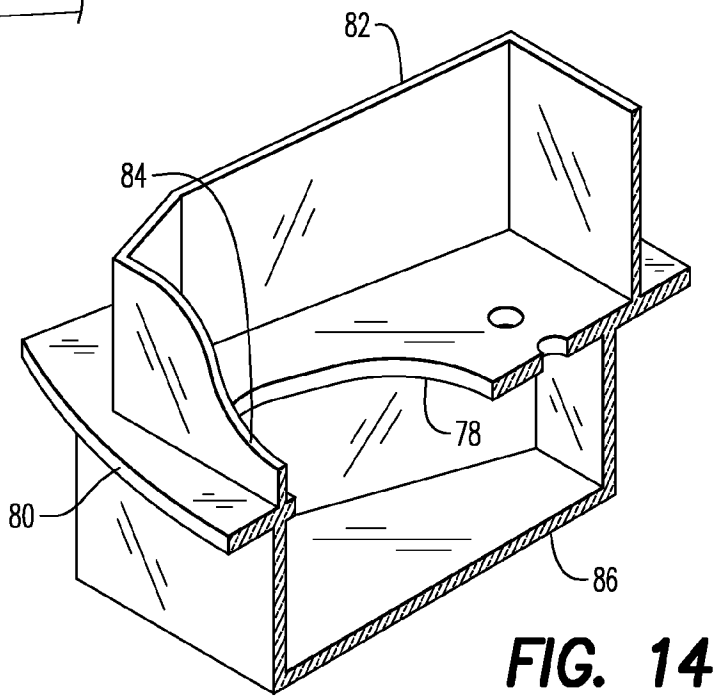
FIG. 14 is a section view in the direction of arrows 14-14 in FIG. 13.

Referring in more detail to FIG. 15, the preferred embodiment of the invention will also include a canopy 90 having upright pole supports 92 and 98 connected between supports attached to the frame 12 and a tubular canopy bow 94. Moreover, with the user positioned in a prone position with the hands in a supported position gripping the upright support members 26 (FIG. 13), the thumbs of the user may easily have access to the joysticks 70 and 72 to steer and propel the apparatus 10. The face-down orientation of the head of the user comfortably fits into and is supported by a viewing box 74 supported on frame 12 by mounting flange 80 best seen in FIGS. 13 and 14. The viewing box 82 includes a neck clearance 84 and a facial opening 78 which positions the eyes of the viewer above a transparent viewing bottom 86 which will typically be submerged for clear underwater viewing.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A snorkeler flotation apparatus comprising:

a frame having a tubular perimeter defining an open interior space having a support netting stretched across the open interior space and being configured to support a snorkeler lying in a prone, face down position atop the support netting while snorkeling;

a plurality of spaced apart elongated rigid arms, each of the arms being pivotably attached at a proximal end thereof by one of a plurality of selectably angularly positionable arm mount assemblies to a first and a second side of the frame;

a buoyant float positioned on a distal end of each arm, each arm being independently selectively fixably positionable by adjustment of the corresponding arm mount assembly between an upright storage position and a laterally extended use position to buoyantly support the frame in water;

the frame being buoyantly positionable on or proximate to the surface of the water by the independent selected angular positioning of each of the arm mount assemblies whereby the face of the snorkeler is in viewable communication with, and to see beneath, the surface of the water.

2. A snorkeler flotation apparatus as set forth in claim 1 comprising:

a propulsion apparatus mounted to the frame.

3. A snorkeler flotation apparatus as set forth in claim 2 further comprising:

a control apparatus having first and second hand controls for operating the propulsion apparatus, the first hand controls being mounted to a forward end of the frame for a user in a prone position, the second hand control being mounted in proximity to a mid-section of the frame for a user in a seated position.

4. A snorkeler flotation apparatus as set forth in claim 3 further comprising:

a viewing box positioned at a forward end of the frame for underwater viewing by the prone individual.

5. A snorkeler flotation apparatus consisting of:

a frame having a tubular perimeter defining an open interior space having a support netting stretched across the open interior space and being configured to support a snorkeler lying in a prone, face down position atop the support netting while snorkeling;

a plurality of spaced apart elongated rigid arms, each of the arms being pivotably attached at a proximal end thereof by one of a plurality of selectably angularly positionable arm mount assemblies to a first and a second side of the frame;

a buoyant float positioned on a distal end of each arm, each arm being independently selectively fixably positionable by adjustment of the corresponding arm mount assembly between an upright storage position and a laterally extended use position to buoyantly support the frame in water;

the frame being buoyantly positionable on or proximate to the surface of the water by the independent selected angular positioning of each of the arm mount assemblies whereby the face of the snorkeler is in viewable communication with, and to see beneath, the surface of the water.

* * * * *